US006180594B1

(12) United States Patent
Fender et al.

(10) Patent No.: US 6,180,594 B1
(45) Date of Patent: Jan. 30, 2001

(54) LOW-CONCENTRATION, HIGH-VISCOSITY AQUEOUS FABRIC SOFTENERS

(75) Inventors: Michael Fender, Flieden; Hans-Jurgen Kohle, Schluchtern; Simone Schussler, Bad Orb, all of (DE)

(73) Assignee: Witco Surfactants GmbH (DE)

( * ) Notice: Under 35 U.S.C. 154(b), the term of this patent shall be extended for 0 days.

(21) Appl. No.: 09/438,695

(22) Filed: Nov. 11, 1999

(30) Foreign Application Priority Data

Dec. 1, 1998 (DE) ..... 198 55 366

(51) Int. Cl.[7] ..... C11D 1/62
(52) U.S. Cl. ..... 510/527; 510/522
(58) Field of Search ..... 510/522, 527

(56) References Cited

U.S. PATENT DOCUMENTS

| | | | |
|---|---|---|---|
| 3,349,033 | | 10/1967 | Zuccarelli et al. . |
| 3,644,203 | | 2/1972 | Lamberti et al. . |
| 3,915,867 | | 10/1975 | Kang et al. . |
| 3,946,115 | | 3/1976 | Brever et al. . |
| 3,997,453 | | 12/1976 | Wixon . |
| 4,073,735 | | 2/1978 | Ramachandran . |
| 4,119,545 | | 10/1978 | Chazard et al. . |
| 4,137,180 | | 1/1979 | Naik et al. . |
| 4,830,771 | | 5/1989 | Ruback et al. . |
| 5,705,663 | * | 1/1998 | Brock et al. ..... 554/110 |
| 5,726,144 | * | 3/1998 | Dewez et al. ..... 510/522 |
| 5,750,490 | * | 5/1998 | Wilsch-Irrgang et al. ..... 510/504 |
| 5,869,716 | * | 2/1999 | Pi Subirana et al. ..... 554/114 |
| 5,916,863 | * | 6/1999 | Iacobucci et al. ..... 510/329 |
| 6,037,315 | * | 3/2000 | Franklin et al. ..... 510/123 |
| 6,110,887 | * | 8/2000 | Euler et al. ..... 510/527 |

FOREIGN PATENT DOCUMENTS

| | | | |
|---|---|---|---|
| 0 239 910 A2 | | 10/1987 | (EP) . |
| WO 94/20597 | * | 9/1994 | (WO) . |

* cited by examiner

*Primary Examiner*—John Hardee
(74) *Attorney, Agent, or Firm*—Scully, Scott, Murphy & Presser

(57) ABSTRACT

The invention relates to a low-concentration, high-viscosity aqueous laundry fabric softener dispersion based on quaternary triethanolamine fatty acid esters and having a defined ratio of triethanolamine to fatty acid, the fatty component having a specific degree of saturation.

11 Claims, No Drawings

LOW-CONCENTRATION, HIGH-VISCOSITY AQUEOUS FABRIC SOFTENERS

FIELD OF THE INVENTION

The present invention relates to low-concentration, high-viscosity aqueous fabric softeners which are in the form of aqueous emulsions or dispersions.

BACKGROUND OF THE INVENTION

As is known in the washing of textiles, fabric softeners are used in the final wash cycle. The use of fabric softeners in this fashion reduces hardening of the washed fabric which is caused by drying. The handle, i.e. feel, of textiles treated in this way, such as hand and bath towels and also underwear and bed linen, is favorably influenced.

Prior art fabric softeners typically contain cationic compounds, for example quaternary ammonium compounds, which, as well as long-chain alkyl radicals, may also contain ester or amide groups. Such fabric softeners are described for example, in U.S. Pat. Nos. 3,349,033; 3,644,203; 3,946,115; 3,997,453; 4,073,735 and 4,119,545. The above mentioned components are added to the rinse bath on their own or in mixtures with other cation-active agents or neutral substances in the form of aqueous dispersions.

Frequent use is made of ammonium compounds that contain ester bonds, as described, for example, in EP-A-0 239 910 and U.S. Pat. Nos. 3,915,867; 4,137,180 and 4,830,771.

Ester compounds based on triethanolamine, such as N-methyl, N,N-bis(beta-$C_{14-18}$-acyloxyethyl), N-betahydroxy-ethyl-ammonium methosulfate, marketed under tradenames such as TETRANYL® AT 75 (trademark of KAO Corp.), STEPANTEX® VRH 90 (trademark of Stepan Corp.) or REWOQUAT® WE 18 (trademark of Witco Surfactants GmbH) are particularly widespread.

These esterquats have virtually replaced the previous raw materials distearyldimethylammonium chloride (DSDMAC) and imidazolinium quats throughout Europe. However, consumer requirements for these compositions vary considerably within this market.

In Northern and Central Europe, concentrates with contents of esterquats of 18–20% and a low viscosity of about 50–200 mPas are currently acceptable, while consumers in Southern and Eastern Europe prefer low concentrations of 3 to 10% by weight, in particular from 4 to 5% by weight.

The disadvantage which is criticized by consumers in the case of formulations with the low concentrations is the low viscosity and thus their consistency. Referring to the formerly used raw materials, a significantly higher viscosity is required in order to give these products a creamy, gentle appearance.

The viscosities of these products, which are desired or required to achieve the desired effect, are in the range from about 500 mPas or, preferably, above. This order of magnitude can be achieved without problem employing the traditionally used laundry softener raw materials (including DSDMAC) without the need of additional viscosity regulators. In the case of the esterquats, because of the different viscosity behavior of these raw materials, it has become difficult to achieve the desired high viscosities without additional expensive thickeners.

The disadvantages of using expensive thickeners include relatively high raw material costs and, as a result of additional stirring in and swelling of the thickeners, significantly extended production times.

Attempts already have been made to replace the partially hydrogenated fatty acids, which are used as standard in the preparation of esterquats and are based on alkanolamines and fatty acids, with completely hydrogenated fatty acids. According to experience, this should result in a significantly high viscosity. However, this is not the case to the desired extent.

It is thus even more surprising that the grade according to the present invention has unexpectedly positive viscosity behavior, which makes it possible to achieve the desired high viscosity without further additives.

SUMMARY OF THE INVENTION

One object of the present invention is to overcome the abovementioned disadvantages of conventional, low-concentration fabric softener formulations and to provide laundry fabric softeners which, in addition to good biodegradability, have a significantly improved level of good soft handle with retention of good rewetting power, yet achieve viscosities of >500 mPas without the addition of thickeners.

This object is achieved using quaternary fatty acid amino alcohol esters of triethanolamine with partially hydrogenated fatty acids in the ratio from 1:1.6 to 1:2 in alcohols or glycols.

Using processes known per se (batch and continuous processes), these products can be used to prepare stable low-viscosity fabric softener dispersions having a creamy appearance.

The present invention thus provides low-concentration, high-viscosity aqueous fabric softeners comprising from 3 to 10% by weight, preferably from 4 to 5% by weight, of at least one of the compounds of the general formula (I)

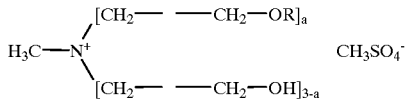

(I)

in which R is a radical of a fatty acid having from 14 to 18 carbon atoms and an iodine number in the range from 15–25, and a can be=1, 2 or 3, with the proviso that the ratio of OH groups to the radical R is=1:1.6 to 1:2.

The present invention further provides a process for the preparation of low-concentration, high-viscosity fabric softener formulations, which comprises introducing and dispersing compounds of the general formula (I) in water preheated to temperatures between 28° C. and 45° C., optionally with the co-use of solvents, dyes and perfume oils.

DETAILED DESCRIPTION OF THE INVENTION

The quaternary compounds of general formula (I) above, which are co-used according to the present invention, are prepared by processes generally known in this field, i.e. by esterification or transesterification of triethanolamine with a fatty acid and subsequent quaternization.

The fatty acid component used for the esterification or transesterification reaction is a monobasic fatty acid that is based on natural vegetable and animal oils having, in particular, 14–18 carbon atoms. Such monobasic fatty acids are conventional and are well known in this field. Illustrative examples of monobasic fatty acids include, but are not limited to: tallow fatty acids, palm fatty acids and the methyl or ethyl esters thereof.

The content of unsaturated components in these fatty acids or fatty acid esters is, if necessary, adjusted to iodine numbers between 15–25 using known catalytic hydrogenation processes, or achieved by mixing completely hydrogenated fatty components with nonhydrogenated fatty components.

The iodine number, as a measure of the average degree of saturation of a fatty acid, is the amount of iodine which is taken up by 100 g of the compound to saturate the double bonds.

According to the present invention, preference is given to partially hydrogenated tallow fatty acids and palm fatty acids having iodine numbers between 15–25. Such compounds are commercially available products and are supplied by various companies under their respective tradenames.

The esterification or transesterification reaction is carried out by processes well known in the art. In this regard, the triethanolamine is reacted with an amount of fatty acid or fatty acid ester corresponding to the desired degree of esterification under nitrogen at 160°–240° C. A catalyst, e.g. methanesulfonic acid, may be optionally used in the reaction. The water of reaction which forms and the alcohol are continuously distilled off. If necessary, it is possible to bring the reaction to completion by reducing the pressure.

The subsequent quaternization is also carried out by known processes. According to the present invention, the process preferably involves adding equimolar amounts of the quaternizing agent to the ester, optionally with co-use of a solvent such as isopropanol, ethanol, 1,2-propylene glycol and/or dipropylene glycol. Quaternization is typically carried out at 60°–90° C. with stirring and, if necessary, under pressure. The completion of the quaternization reaction is monitored by checking the overall amine number.

Examples of quaternizing agents which can be co-used in the present invention are short-chain dialkyl phosphates and sulfates, such as diethyl sulfate, dimethyl phosphate, diethyl phosphate and short-chain halogenated hydrocarbons. In particular, dimethyl sulfate is used in the present invention.

To prepare the quaternary ammonium compounds, triethanolamine (TEA) and fatty acids are reacted and quaternized by customary processes.

The fatty acids used were:

Fatty Acid I (FAI)

Tallow fatty acid having an acid number of 202–208, an iodine number of 36–44 and a carbon chain distribution as follows:

| | |
|---|---|
| <C 16 | ca. 2% |
| C 16 | ca. 25% |
| C 16' | ca. 2% (' monounsaturated) |
| C 17 | ca. 2% |
| C 18 | ca. 28% |
| C 18' | ca. 37% |
| C 18" | ca. 3% (" diunsaturated) |
| >C 18 | ca. 2% |

Fatty Acid II (FA II)

Palm fatty acid having an acid number of 205–212, an iodine number of 30–40 and a carbon chain distribution as follows:

| | |
|---|---|
| <C 16 | ca. 2% |
| C 16 | ca. 46% |
| C 16' | ca. 1% |
| C 17 | - - - |
| C 18 | ca. 13% |
| C 18' | ca. 36% |
| C 18" | ca. 2% |
| >C 18 | ca. 1% |

Fatty Acid III (FA III)

Tallow fatty acid having an acid number of 202–208, an iodine number of 15–25 and a carbon chain distribution as follows:

| | |
|---|---|
| <C 16 | ca. 2% |
| C 16 | ca. 30% |
| C 16' | - - - |
| C 17 | ca. 2% |
| C 18 | ca. 47% |
| C 18' | ca. 17% |
| C 18" | ca. 1% |
| >C 18 | ca. 2% |

Quaternization was carried out with dimethyl sulfate (Formula I: $R=CH_3$, $A^-=CH_3SO_4^-$)

Component A: $[TEA:FAI=1:2]^+A^-$

Component B: $[TEA:FAI=1:1.77]^+A^-$

Component C: $[TEA:FAII=1:1.2]^+A^-$

Component D: $[TEA:FAII=1:1.6]^+A^-$

Component E: $[TEA:FAIII=1:1.2]^+A^-$

Component F: $[TEA:FAIII=1:1.85\ ]^+A^-$

Fabric softeners are prepared by emulsification or dispersion of the respective individual components in water. In this connection, it is possible to use the methods which are customary in this field.

The process usually involves initially introducing water which has been preheated to between 28° C. and 45° C., dispersing one after the other, with thorough stirring, firstly the dye solution, then the antifoam emulsion, which is optionally required, and finally the melt of the individual softeners. Perfume oil is metered in and the mixture is then left to cool to room temperature with stirring.

The fabric softeners according to the invention may comprise said components within the limits desired in this field, such as, for example, 3 to 10% by weight, preferably 4 to 5% by weight, of the compounds of the general formula (I); 0.2–2% by weight of a solvent such as, in particular, isopropanol, ethanol, propylene glycol and dipropylene glycol; 0.1–1.0% by weight of perfume oil and topped up to 100% by weight (ad 100) with water.

In principle, it can be assumed that the lower the water temperature used, the higher the viscosity.

Like the prior art fabric softeners, the softeners according to the present invention are added after the actual washing process in the final rinse cycle. The use concentration is, after dilution with water, in the range of 0.1–1.0 g of at least one of the compounds of the general formula (I) per rinse cycle, depending on the field of use.

The following examples are given to illustrate some of the advantages that can be obtained from the present invention.

EXAMPLES

Using this process (batchwise), the components given are used to prepare dispersions:

Example 1

| | |
|---|---|
| 5.5. g | Component A |
| 0.20 g | Dye (1% strength solution of SANDOLAN ® Walkblau NBL 150 from Sandoz) |
| 0.20 g | Fragrance ® perfume oil (D 60515 W from Haarmann und Reimer GmbH) |
| ad 100 | water, 9° German hardness, 40° C. |

Viscosity at 20° C.: ~50 mPas

Example 2

| | |
|---|---|
| 5.5. g | Component B |
| 0.20 g | Dye (1% strength solution of SANDOLAN ® Walkblau NBL 150 from Sandoz) |
| 0.20 g | Fragrance ® perfume oil (D 60515 W from Haarmann und Reimer GmbH) |
| ad 100 | water, 9° German hardness, 30° C. |

Viscosity at 20° C.: ~50 mPas

Example 3

| | |
|---|---|
| 5.5. g | Component C |
| 0.20 g | Dye (1% strength solution of SANDOLAN ® Walkblau NBL 150 from Sandoz) |
| 0.20 g | Fragrance ® perfume oil (D 60515 W from Haarmann und Reimer GmbH) |
| ad 100 | water, 9° German hardness, 45° C. |

Viscosity at 20° C.: ~80 mPas

Example 4

| | |
|---|---|
| 5.5. g | Component D |
| 0.20 g | Dye (1% strength solution of SANDOLAN ® Walkblau NBL 150 from Sandoz) |
| 0.20 g | Fragrance ® perfume oil (D 60515 W from Haarmann und Reimer GmbH) |
| ad 100 | water, 9° German hardness, 30° C. |

Viscosity at 20° C.: ~150 mPas

Example 5

| | |
|---|---|
| 5.5. g | Component E |
| 0.20 g | Dye (1% strength solution of SANDOLAN ® Walkblau NBL 150 from Sandoz) |
| 0.20 g | Fragrance ® perfume oil (D 60515 W from Haarmann und Reimer GmbH) |
| ad 100 | water, 9° German hardness, 45° C. |

Viscosity at 20° C.: ~750 mPas

Example 6

| | |
|---|---|
| 5.5. g | Component E |
| 0.20 g | Dye (1% strength solution of SANDOLAN ® Walkblau NBL 150 from Sandoz) |
| 0.20 g | Fragrance ® perfume oil (D 60515 W from Haarmann und Reimer GmbH) |
| ad 100 | water, 9° German hardness, 35° C. |

Viscosity at 20° C.: ~1000 mPas

Example 7

| | |
|---|---|
| 5.5. g | Component F |
| 0.20 g | Dye (1% strength solution of SANDOLAN ® Walkblau NBL 150 from Sandoz) |
| 0.20 g | Fragrance ® perfume oil (D 60515 W from Haarmann und Reimer GmbH) |
| ad 100 | water, 9° German hardness, 35° C. |

Viscosity at 20° C.: ~480 mPas

While this invention has been particularly shown and described with respect to preferred embodiments thereof, it will be understood by those skilled in the art that the foregoing and other changes in form and detail may be made without departing from the spirit and scope of the present invention. It is therefore intended that the present invention not be limited to the exact forms described and illustrated, but fall within the scope of the appended claims.

What is claimed is:

1. A low concentration, high-viscosity aqueous fabric softener comprising from 3 to 10% by weight of at least one compound having the formula

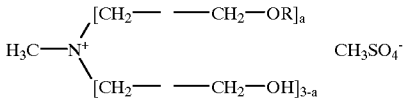

(I)

in which R is a radical of a fatty acid having from 14 to 18 carbon atoms and an iodine number in the range from 15–25, and a can be=1, 2 or 3, with the proviso that the ratio of OH groups to the radical R is=1:1.6 to 1:2.

2. The low concentration, high viscosity aqueous fabric softener of claim 1 wherein from 4 to 5% by weight of said compound having said formula is present therein.

3. The low-concentration, high-viscosity aqueous fabric softener of claim 1 wherein R is the radical of a tallow fatty acid or palm fatty acid having an iodine number from 15 to 20.

4. The low-concentration, high-viscosity aqueous fabric softener of claim 1 wherein the compound of said formula is made by esterification or transesterification of a triethanolamine with a fatty acid and subsequent quaternization.

5. The low-concentration, high-viscosity aqueous fabric softener of claim 1 further comprising a solvent, a dye, perfume oil or mixtures thereof.

6. The low-concentration, high-viscosity aqueous fabric softener of claim 5 wherein said solvent is isopropanol, ethanol, propylene glycol or dipropylene glycol.

7. The low-concentration, high-viscosity aqueous fabric softener of claim 5 wherein said solvent is present in an amount of 0.2–2% by weight.

8. The low-concentration, high-viscosity aqueous fabric softener of claim 5 wherein said perfume oil is present in an amount of 0.1–1.0% by weight.

9. A diluted low-concentration, high viscosity aqueous fabric softener comprising 0.1–1.0 g of at least one compound having the formula recited in claim 1 per rinse cycle.

10. A process for the preparation of a low-concentration, high-viscosity fabric softener formulation, comprising introducing and dispersing compounds of the general formula recited in claim 1 in water, said water being preheated to a temperature between 28° C. and 45° C.

11. The process of claim 10 further comprising introducing and dispersing a solvent, dye, perfume oil, or mixture thereof with said compound of said formula recited in claim 1.

* * * * *

UNITED STATES PATENT AND TRADEMARK OFFICE

CERTIFICATE OF CORRECTION

PATENT NO. : 6,180,594 B1
APPLICATION NO. : 09/438695
DATED : January 30, 2001
INVENTOR(S) : Michael Fender et al.

It is certified that error appears in the above-identified patent and that said Letters Patent is hereby corrected as shown below:

On the Title Page, item (30): "198 55 366" should read --198 55 366.8--

Column 6, line 48: "low concentration, high viscosity" should read --low-concentration, high-viscosity--

Column 7, line 4, Claim 9: "high viscosity" should read --high-viscosity--

Column 7, line 8: after "formulation" insert --havi`ng a minimum viscosity of 480 --mPas--

Column 8, lines 3-6, Claim 11: delete "The process of claim 10 further comprising introducing and dispersing a solvent, dye, perfume oil, or mixture thereof with said compound of said formula recited in claim 1." and insert --The process of Claim 10 wherein solvents, dyes or perfume oils are co-used.--

Signed and Sealed this

Tenth Day of July, 2007

JON W. DUDAS
*Director of the United States Patent and Trademark Office*